US012207696B2

(12) United States Patent
Hinrichsen

(10) Patent No.: US 12,207,696 B2
(45) **Date of Patent: *Jan. 28, 2025**

(54) FIELDER'S MASK WITH FLEXIBLE RETENTION SYSTEM

(71) Applicant: RAWLINGS SPORTING GOODS COMPANY, INC., St. Louis, MO (US)

(72) Inventor: Mitch Hinrichsen, St. Louis, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/406,039

(22) Filed: Jan. 5, 2024

(65) Prior Publication Data

US 2024/0285018 A1 Aug. 29, 2024

Related U.S. Application Data

(63) Continuation of application No. 17/575,348, filed on Jan. 13, 2022, now Pat. No. 11,864,613.

(51) Int. Cl.
*A42B 3/20* (2006.01)

(52) U.S. Cl.
CPC ..... *A42B 3/20* (2013.01)

(58) Field of Classification Search
CPC ..... A42B 3/20; A42B 3/222; A42B 3/223
USPC ..... 2/410, 424, 425, 9, 171, 15
See application file for complete search history.

(56) References Cited

U.S. PATENT DOCUMENTS

| | | | |
|---|---|---|---|
| 2,535,434 | A | 12/1950 | Marietta |
| 3,113,318 | A | 12/1963 | Marietta |
| 3,319,261 | A | 5/1967 | Dunning |
| 4,173,795 | A | 11/1979 | Bravin et al. |
| 4,370,759 | A | 2/1983 | Zide |
| 4,631,758 | A | 12/1986 | Newman et al. |
| 5,095,552 | A | 3/1992 | Parkinson |
| 5,384,914 | A | 1/1995 | Caveness et al. |
| 5,713,082 | A | 2/1998 | Bassette et al. |
| 5,806,088 | A | 9/1998 | Zide et al. |
| 6,012,164 | A | 1/2000 | Deal |
| 6,292,954 | B1 | 9/2001 | Obradaigh et al. |
| 6,421,829 | B2 | 7/2002 | Halstead et al. |
| 6,637,091 | B2 | 10/2003 | Halstead et al. |
| 6,983,487 | B2 | 1/2006 | Rickon |
| 7,000,252 | B1 | 2/2006 | Tobin |
| 7,062,795 | B2 | 6/2006 | Skiba et al. |
| 7,127,747 | B2 | 10/2006 | Darnell et al. |
| 7,540,034 | B2 | 6/2009 | Bologna |
| 7,765,608 | B2 | 8/2010 | Durocher et al. |
| 7,836,517 | B2 | 11/2010 | Durocher et al. |

(Continued)

*Primary Examiner* — Tajash D Patel
(74) *Attorney, Agent, or Firm* — Perkins Coie LLP

(57) ABSTRACT

A fielder's mask includes a headband configured for positioning along the front and side regions of a wearer's head. A faceguard projects downwardly from a front region of the headband to protect the wearer's face from a batted or thrown ball. A rear region of the headband includes downwardly projecting, flexible arms, that secure the fielder's mask to the wearer, while also facilitating efficient, one-handed donning and removal of the fielder's mask. In some embodiments, the flexible arms engage the back of the wearer's head behind the wearer's ears. Elastic straps may be attached to the headband to further secure the fielder's mask to the wearer's head.

20 Claims, 3 Drawing Sheets

(56) References Cited

U.S. PATENT DOCUMENTS

| | | | | |
|---|---|---|---|---|
| 7,987,517 | B2 | 8/2011 | Gait | |
| 7,992,228 | B2 | 8/2011 | Milea et al. | |
| 8,209,770 | B2 | 7/2012 | Page et al. | |
| 8,209,784 | B2 | 7/2012 | Nimmons et al. | |
| D671,687 | S | 11/2012 | Winningham et al. | |
| D678,617 | S | 3/2013 | Erb et al. | |
| 8,695,122 | B2 | 4/2014 | Deboer | |
| 8,719,968 | B2 | 5/2014 | Deboer | |
| 9,027,163 | B1 | 5/2015 | Schmidt | |
| 11,577,148 | B2 * | 2/2023 | Abraham | A63B 71/10 |
| 11,864,613 | B2 * | 1/2024 | Hinrichsen | A42B 3/20 |
| 2003/0070201 | A1 | 4/2003 | Mcclelland | |
| 2006/0053520 | A1 | 3/2006 | Bologna | |
| 2006/0117449 | A1 | 6/2006 | Hahn et al. | |
| 2006/0143765 | A1 | 7/2006 | Halstead et al. | |
| 2007/0044193 | A1 | 3/2007 | Durocher et al. | |
| 2009/0031479 | A1 | 2/2009 | Rush | |
| 2009/0083891 | A1 | 4/2009 | Cote | |
| 2011/0271428 | A1 | 11/2011 | Withnall et al. | |
| 2012/0092611 | A1 | 4/2012 | Reichow et al. | |
| 2012/0210482 | A1 | 8/2012 | Polstein et al. | |
| 2014/0317819 | A1 | 10/2014 | Jurga et al. | |
| 2016/0029733 | A1 | 2/2016 | Kovarik et al. | |
| 2018/0338550 | A1 | 11/2018 | Boulware et al. | |
| 2019/0239592 | A9 | 8/2019 | Tubbs | |
| 2021/0321694 | A1 | 10/2021 | Abraham | |
| 2023/0082869 | A1 | 3/2023 | Hinrichsen | |
| 2024/0251903 | A1 * | 8/2024 | Polstein | A42B 3/20 |

* cited by examiner

FIELDER'S MASK WITH FLEXIBLE RETENTION SYSTEM

CROSS REFERENCE TO RELATED APPLICATIONS

This application is a continuation of U.S. patent application Ser. No. 17/575,348, filed Jan. 13, 2022, which is incorporated herein by reference in its entirety.

BACKGROUND

Existing fielder's masks used in softball and other batted-ball sports typically include a ring-shaped headband that can be positioned around a wearer's head. A faceguard hangs down from the headband to protect the user's face from contact with a ball. A rearwardly positioned strap system is often included to better secure the fielder's mask to the wearer's head. Fielder's masks of this nature are somewhat simplistic and often do not provide a particularly secure fit. Conversely, in designs where a secure fit can be achieved, the wearer typically needs to use two hands to loosen the straps to remove the mask.

SUMMARY

A fielder's mask includes a headband configured for positioning along the front and side regions of a wearer's head. A faceguard projects downwardly from a front region of the headband to protect the wearer's face from a batted or thrown ball. A rear region of the headband includes downwardly projecting, flexible arms, that secure the fielder's mask to the wearer, while also facilitating efficient, one-handed donning and removal of the fielder's mask. In some embodiments, the flexible arms engage the back of the wearer's head behind the wearer's ears. Elastic straps may be attached to the headband to further secure the fielder's mask to the wearer's head.

Other features and advantages will appear hereinafter. The features described herein can be used separately or together, or in various combinations of one or more of them.

BRIEF DESCRIPTION OF THE DRAWINGS

In the drawings, wherein the same reference number indicates the same element throughout the views.

DETAILED DESCRIPTION

Figure 1:
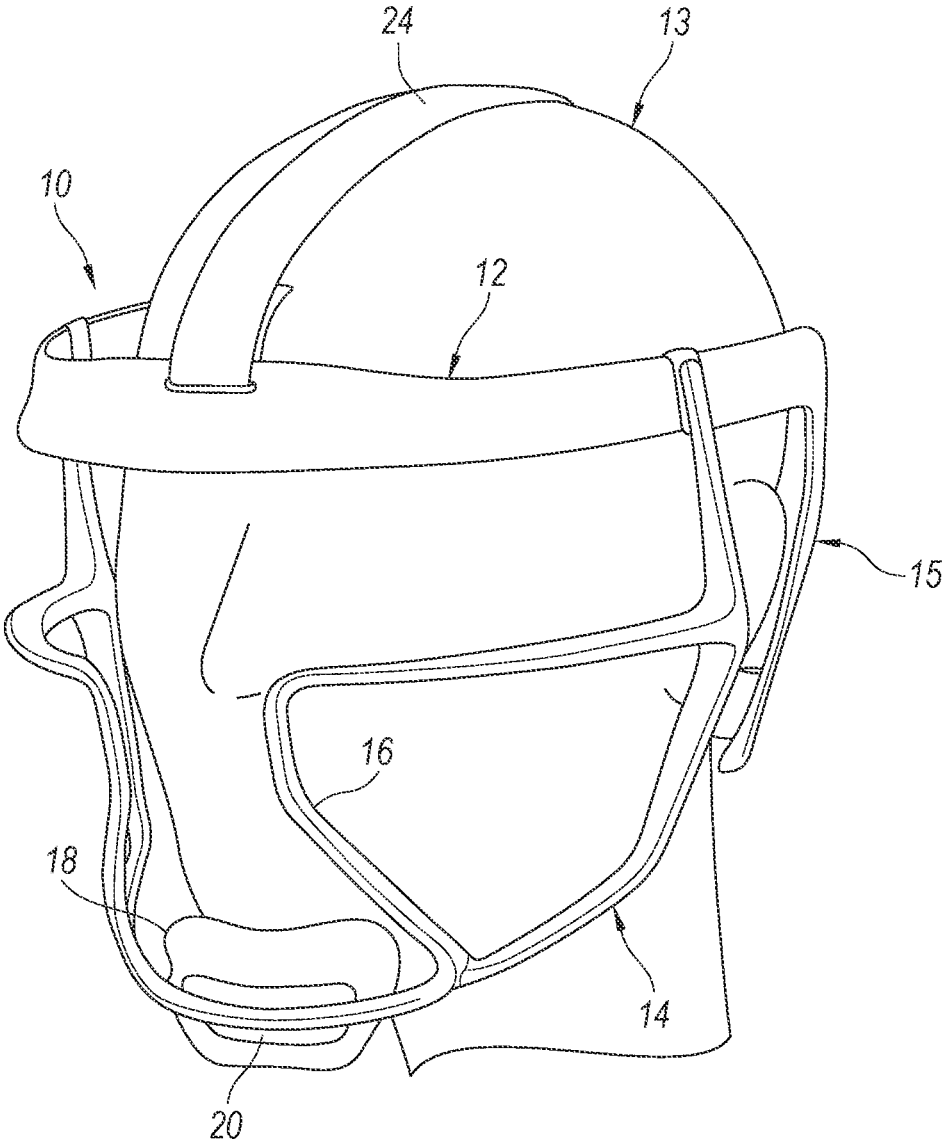
FIG. 1 is a perspective view of a fielder's mask positioned on a head according to one embodiment of the present technology.

The present technology is directed to a fielder's mask with a flexible retention system. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to masks and mask-retention systems, may not be shown or described in detail to avoid unnecessarily obscuring the relevant description of the various embodiments. Accordingly, embodiments of the present technology may include additional elements or exclude some of the elements described below with reference to FIGS. 1-5, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

As generally illustrated in FIGS. 1-4, embodiments of the present technology may include a fielder's mask 10 including a headband 12 and a faceguard 14. The headband 12 may be configured to be positioned along the front and sides of a wearer's head 13. In other embodiments, the headband 12 may extend to the back of the wearer's head 13 or may encircle the wearer's head 13. The headband 12 may be made of acrylonitrile butadiene styrene (ABS), polycarbonate, or another polymer or other suitable material.

The faceguard 14 may include one or more bars 16 or wires arranged to prevent a batted or thrown ball from contacting a wearer's face. The faceguard 14 may be made of stainless steel, aluminum, carbon steel, a rigid polymer, or another material suitable for preventing a ball from striking a wearer's face. In some embodiments, the headband 12 may be riveted, bolted, screwed, or otherwise attached to the faceguard 14. In other embodiments, the headband 12 may be attached to the faceguard 14 in another suitable manner, or it may be co-molded with the faceguard 14.

A chin guard 18 may be included on the faceguard 14 to protect the wearer's chin and provide a comfortable fit. The chin guard 18 may be made of an encapsulated, open-cell foam or another suitable material. The chin guard 18 may be attached to a molded metal plate 20 or similar structure on the faceguard 14 via hook-and-loop fasteners (e.g., Velcro®) or via another suitable fastener or connector.

Figure 3:
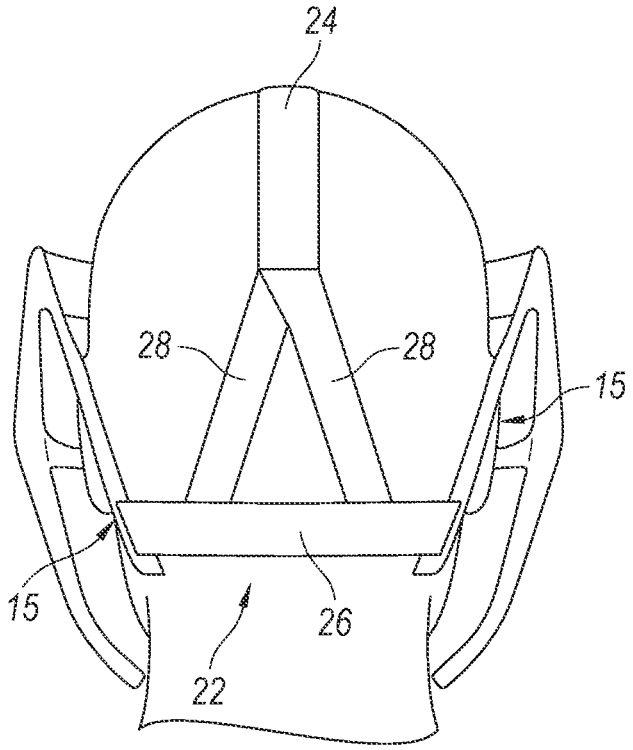
FIG. 3 is a rear view of the fielder's mask shown in FIGS. 1-2.
Figure 4:
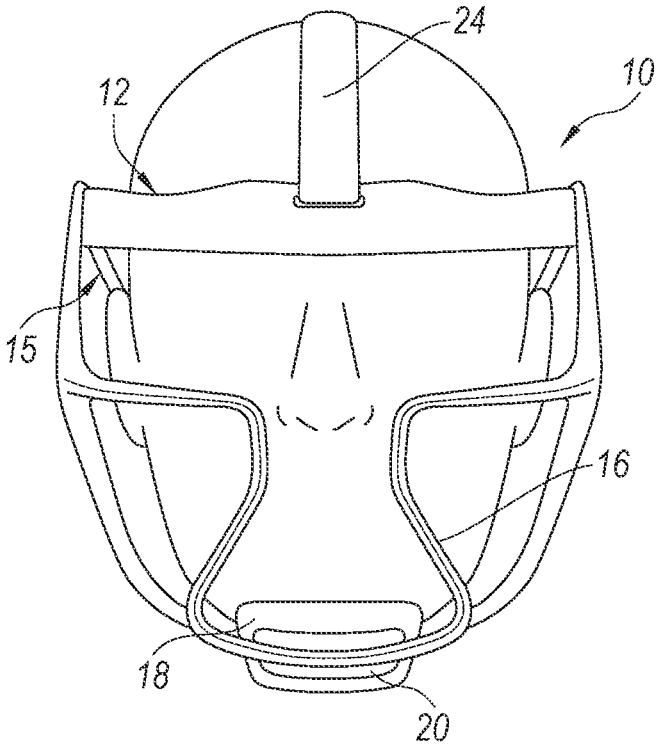
FIG. 4 is a front view of the fielder's mask shown in FIGS. 1-3.
Figure 5:
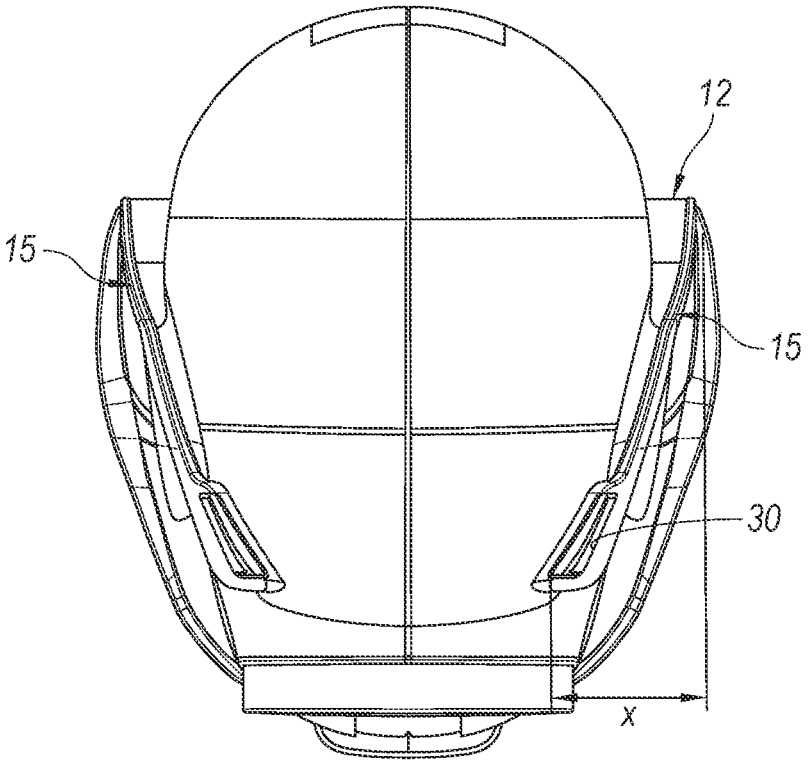
FIG. 5 is a rear view of the fielder's mask shown in FIGS. 1-4 with the straps omitted.

In some embodiments, the headband 12 includes downwardly projecting rear arms 15 that aid in securing the fielder's mask 10 to a wearer, while also facilitating easy donning and removal of the fielder's mask 10. The rear arms 15 may be configured to extend behind the wearer's ears, and optionally below the wearer's ears. The rear arms 15 may also extend partially behind the wearer's head 13, as best shown in FIGS. 3 and 5.

Figure 2:
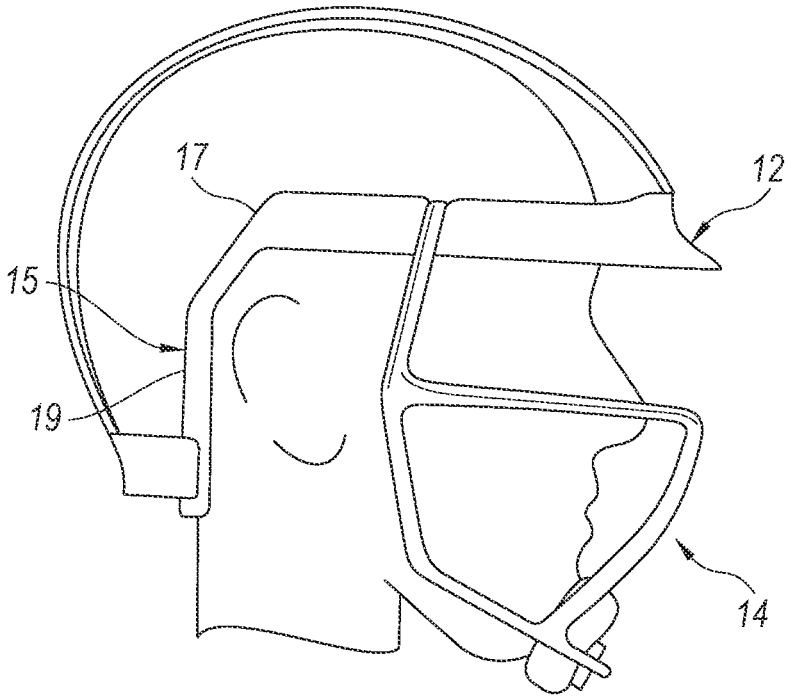
FIG. 2 is a side view of the fielder's mask shown in FIG. 1.

In some embodiments, the rear arms 15 may each include an angled portion 17 that extends behind a wearer's ear, and a second portion 19 that projects downwardly from the angled portion 17 and generally perpendicularly to the upper portion of the headband 12, as best shown in FIG. 2. In other embodiments, the upper portion of the headband 12 may extend past the wearer's ears, and the rear arms 15 may project straight down, or substantially straight down, such that the angled portions 17 are omitted.

The rear arms 15 are preferably configured to flex when subjected to a force—such as the force from a wearer's head when the faceguard 14 is pulled forward, upward, downward, or sideways—to facilitate donning and removal of the fielder's mask 10. The material used to form the rear arms 15, therefore, is preferably relatively flexible, such as ABS, polycarbonate, or another suitable polymer. In some embodiments, the headband 12 and its rear arms 15 are formed of the same material, such that they may be injection molded or otherwise formed as a single piece. In other embodiments, the rear arms 15 may be made from a different material than the rest of the headband 12, and may be riveted, bolted, screwed, or otherwise attached to the upper portion of the headband 12. In such an embodiment, the upper portion of the headband 12 could optionally be made of a stiffer material than the rear arms 15 of the headband 12.

In some embodiments, an elastic strap system 22 or webbing may be included to aid in securing the fielder's mask 10 to a wearer's head 13. The strap system 22 may include a central strap 24 connected to the upper front region of the headband 12 that runs to the back of the wearer's head 13. In some embodiments, the forward end of the central strap 24 may pass through an opening in the headband 12 and loop back toward—and be stitched or otherwise connected to—an underside of the central strap 24. In other embodiments, the central strap 24 may be connected to the upper front region of the headband 12 via rivets, bolts, screws, or another suitable connector.

The strap system 22 may further include a lateral rear strap 26 connected to the rear arms 15, optionally to lower regions of the rear arms 15. In some embodiments, two or more stability straps 28 may be stitched or otherwise connected to the central strap and the rear strap 26 to aid in providing a secure fit to the wearer's head 13. In other embodiments, the stability straps 28 may be omitted, and the central strap 24 may be stitched or otherwise directly connected to the rear strap 26.

As shown in FIG. 5, the rear arms 15 may each include an opening 30 through which ends of the rear strap 26 may pass. The ends of the rear strap 26 may pass through the openings 30 and loop back toward—and be stitched or otherwise connected to—portions of the rear strap 26 located between the openings 30. In other embodiments, the ends of the rear strap 26 may be connected to the rear arms 15 via rivets, bolts, screws, or another suitable connector.

In some embodiments, each rear arm 15 may be capable of deflecting outwardly to a position in which it is substantially vertically aligned with the ends of the front portion of the headband 12. For example, each rear arm 15 may be capable of deflecting a distance X of approximately 1.6 to 2.0 inches, or approximately 1.8 inches. In other embodiments, the rear arms 15 may be more or less flexible, such that they are capable of deflecting greater or lesser distances.

In use, when a player wants to remove the fielder's mask 10, the player may pull forward or upward on one or more bars 16 or wires of the faceguard 14, or on the chin guard 18, causing the elastic straps to stretch and one or both rear arms 15 to deflect outwardly, thereby loosening the fit and facilitating easy removal of the fielder's mask 10. When donning the fielder's mask 10, the player may hold the mask 10 slightly above or against the top of the player's head, then pull forward or downward on one or more bars 16 or wires of the faceguard 14, or on the chin guard 18, to stretch the elastic straps and deflect the rear arms 15 outwardly, thereby expanding the opening into the fielder's mask 10 and allowing it to easily move down into a secure position on the player's head.

Fielder's masks 10 configured as described herein provide an improved, secure attachment to a wearer's head, while also facilitating one-handed donning and removal of the mask 10 due to the flexibility of the rear arms 15 in conjunction with the elasticity of the strap system 22. This configuration also prevents, or substantially prevents, the fielder's mask 10 from getting caught on the wearer's ears during donning or removal.

Specific details of embodiments of the present technology are described herein with reference to fielder's masks and mask-retention systems. Embodiments of the present technology may be used in fast-pitch softball, slow-pitch softball, baseball, or other sports involving a ball or other projectile. The dimensions of the faceguard 14 may be selected to prevent passage of a given ball, such that the spacing of the bars 16 or wires in the faceguard may be greater when used in softball than when used in baseball, for example.

From the foregoing, it will be appreciated that specific embodiments of the disclosed technology have been described for purposes of illustration. Various modifications may be made without deviating from the technology, however, and some embodiments may omit some elements. While advantages associated with certain embodiments of the disclosed technology have been described in the context of those embodiments, other embodiments may also exhibit such advantages, and not all embodiments need to exhibit such advantages to fall within the scope of the technology. Accordingly, the disclosure and associated technology may encompass other embodiments not expressly shown or described herein.

What is claimed is:

1. A fielder's mask, comprising:

a headband configured to be positioned along at least a front part of a wearer's head;

two arms projecting downwardly from the headband and configured to engage sides of the wearer's head;

a plurality of bars forming at least part of a faceguard, the plurality of bars comprising two first bars and at least one second bar, wherein the at least one second bar forms a lower part of the faceguard, wherein each first bar of the two first bars includes a laterally-extending portion and a transverse portion projecting downwardly from the laterally-extending portion, wherein the transverse portions connect the laterally-extending portions to the at least one second bar; and an elastic strap system connected to the headband and to the arms.

2. The fielder's mask of claim 1 wherein the elastic strap system includes a rear strap connected to the arms.

3. The fielder's mask of claim 2 wherein each of the arms includes an opening for accommodating an end of the rear strap, and wherein the rear strap is attached to the rear arms via the openings.

4. The fielder's mask of claim 2 wherein the elastic strap system further includes a central strap connected at a first end to the headband and connected at a second end directly or indirectly to the rear strap.

5. The fielder's mask of claim 4 wherein the elastic strap system further includes a plurality of stability straps connecting the central strap to the rear strap.

6. The fielder's mask of claim 1, further comprising a plate connected to a lower portion of the faceguard, distal from the headband, and configured to support a chin guard.

7. The fielder's mask of claim 1 wherein each of the arms is outwardly deflectable a distance of approximately 1.6 to 2.0 inches.

8. The fielder's mask of claim 1 wherein at least part of each transverse portion extends laterally outwardly and downwardly between the at least one second bar and the two first bars.

9. The fielder's mask of claim 1 wherein each of the arms includes an angled portion configured to extend behind one of the wearer's ears, and a second portion projecting downwardly from the angled portion.

10. A fielder's mask, comprising:

a headband including (a) a first portion configured to be positioned along at least a front part of a wearer's head and extending along at least part of each side of the wearer's head, and (b) two arms projecting downwardly from the first portion;

a faceguard attached to the headband, the faceguard comprising (i) a pair of laterally-opposed first bars, wherein each first bar comprises a laterally-extending portion and a transverse portion extending transversely relative to the laterally-extending portion; (ii) a laterally and downwardly extending second bar positioned at least partially below each laterally-extending portion; and (iii) a plate attached to the second bar;

a central strap connectable to the first portion of the headband and extending rearwardly; and a rear strap connectable to each arm and directly or indirectly connectable to the central strap;

wherein, for each of the laterally-opposed first bars, the transverse portion is attached to the second bar, and at least part of the transverse portion extends laterally outwardly and downwardly between the laterally-extending portion and the second bar.

11. The fielder's mask of claim 10 wherein the rear strap is connected to lower portions of the arms.

12. The fielder's mask of claim 11 wherein each of the arms includes an opening for accommodating an end of the rear strap, and wherein the rear strap is attached to the arms via the openings.

13. The fielder's mask of claim 10 further including a plurality of stability straps connecting the central strap to the rear strap.

14. The fielder's mask of claim 10 wherein each of the arms is outwardly deflectable a distance of approximately 1.6 to 2.0 inches.

15. The fielder's mask of claim 14 wherein each of the arms is outwardly deflectable a distance of approximately 1.8 inches.

16. The fielder's mask of claim 10 further comprising a chin guard attached to the plate.

17. The fielder's mask of claim 10 wherein each of the arms includes an angled portion configured to extend behind one of the wearer's ears.

18. A fielder's mask, comprising:

a headband configured to be positioned along at least a front part of a wearer's head;

a faceguard supported by the headband, the faceguard comprising a plurality of bars;

a central strap connected to the headband and extending rearwardly; and a rear strap connected to the headband and directly or indirectly connected to the central strap;

wherein the plurality of bars comprises (a) two laterally-opposed first bars, wherein each first bar comprises a laterally-extending portion and a transverse portion extending transversely relative to the laterally-extending portion, and (b) a second bar projecting below the laterally-extending portions; and wherein, for each of the laterally-opposed first bars, the transverse portion connects the laterally-extending portion to the second bar.

19. The fielder's mask of claim 18, wherein, for each of the laterally-opposed first bars, at least part of the transverse portion extends laterally outwardly and downwardly between the laterally-extending portion and the second bar.

20. The fielder's mask of claim 18, further comprising a plate connected to at least the second bar.

* * * * *